US007104047B2

(12) United States Patent
Takubo

(10) Patent No.: US 7,104,047 B2
(45) Date of Patent: Sep. 12, 2006

(54) AIR-FUEL RATIO CONTROL DEVICE FOR INTERNAL COMBUSTION ENGINE

(75) Inventor: Hideki Takubo, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 100 days.

(21) Appl. No.: 11/005,007

(22) Filed: Dec. 7, 2004

(65) Prior Publication Data

US 2006/0005533 A1 Jan. 12, 2006

(30) Foreign Application Priority Data

Jul. 9, 2004 (JP) ..... 2004-203215

(51) Int. Cl.
*F01N 3/00* (2006.01)

(52) U.S. Cl. ..... 60/285; 60/276; 123/198 F; 123/481

(58) Field of Classification Search ..... 60/276, 60/285, 299; 123/198 F, 481; 701/103, 701/109

See application file for complete search history.

(56) References Cited

U.S. PATENT DOCUMENTS 5,092,123 A * 3/1992 Nada et al. ..... 60/274
5,293,740 A 3/1994 Heppner
5,392,598 A * 2/1995 White et al. ..... 60/285
5,842,340 A * 12/1998 Bush et al. ..... 60/285
5,901,552 A * 5/1999 Schnaibel et al. ..... 60/285
6,226,982 B1 * 5/2001 Poggio et al. ..... 60/276
6,405,527 B1 * 6/2002 Suzuki et al. ..... 60/285
6,453,665 B1 * 9/2002 Bower et al. ..... 60/276
6,637,194 B1 * 10/2003 Kakuyama et al. ..... 60/285
6,854,262 B1 * 2/2005 Yoshizawa et al. ..... 60/276
6,901,744 B1 * 6/2005 Kako et al. ..... 60/285

FOREIGN PATENT DOCUMENTS

JP 5-195842 A 8/1993
JP 6-42387 A 2/1994
JP 2641827 B2 5/1997
JP 2000-120475 A 4/2000

* cited by examiner

*Primary Examiner*—Thomas Denion
*Assistant Examiner*—Diem Tran
(74) *Attorney, Agent, or Firm*—Sughrue Mion, PLLC

(57) ABSTRACT

An integral operation in an upstream target-value varying part is stopped in response to transition to a fuel cutoff state to maintain an integral value concerning a downstream side. Thereafter, at a time of removal of the fuel cutoff state, a cumulative-air-intake-amount detecting part detects a cumulative air amount of air taken into an engine. Then, when the cumulative air amount reaches a predetermined air amount, an integral-operation-stop/restart controlling part restarts the integral operation in the upstream target-value varying part to update integral values concerning the downstream side in a time sequence.

6 Claims, 7 Drawing Sheets

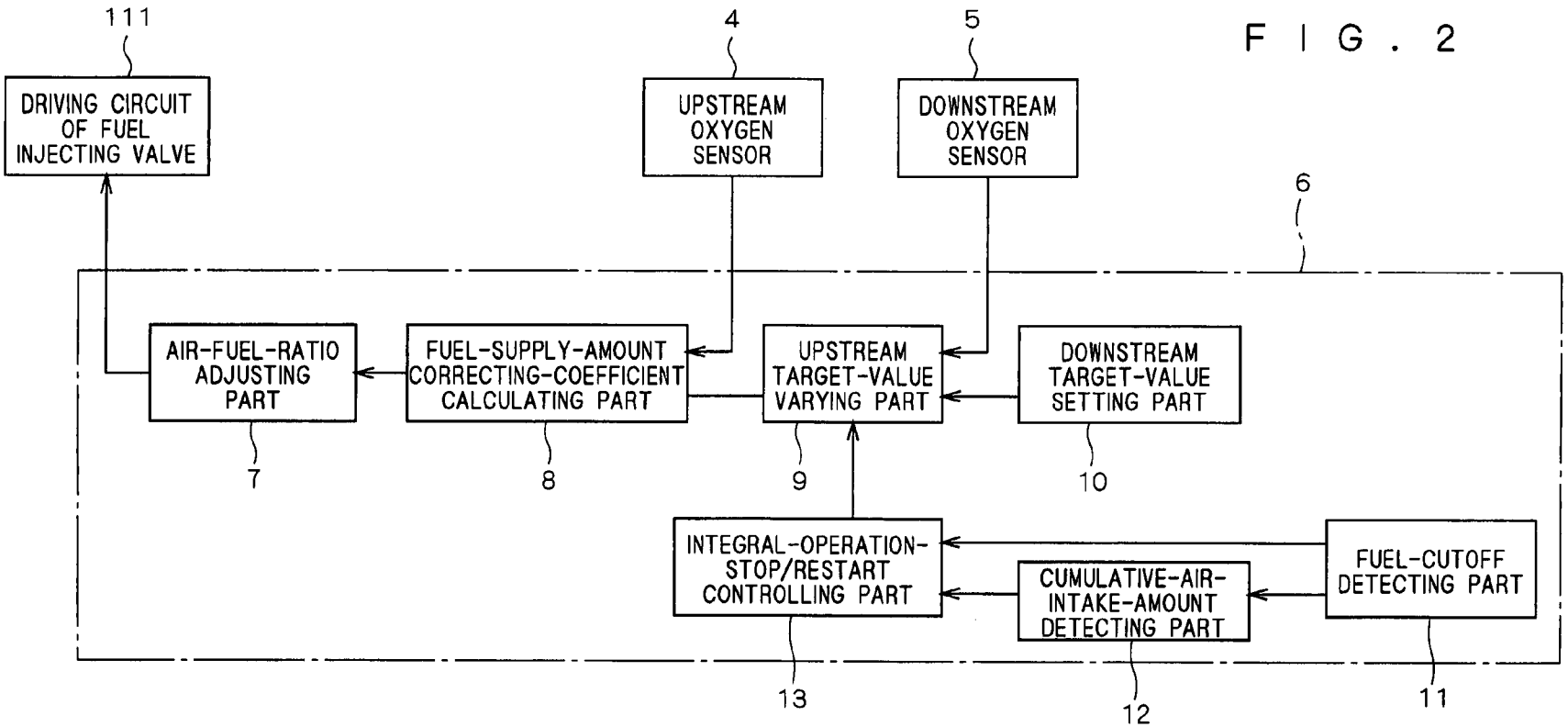
FIG. 2
6
DOWNSTREAM OXYGEN SENSOR
5
UPSTREAM OXYGEN SENSOR
4
DRIVING CIRCUIT OF FUEL INJECTING VALVE
111
DOWNSTREAM TARGET-VALUE SETTING PART
10
UPSTREAM TARGET-VALUE VARYING PART
9
FUEL-SUPPLY-AMOUNT CORRECTING-COEFFICIENT CALCULATING PART
8
AIR-FUEL-RATIO ADJUSTING PART
7
FUEL-CUTOFF DETECTING PART
11
CUMULATIVE-AIR-INTAKE-AMOUNT DETECTING PART
12
INTEGRAL-OPERATION-STOP/RESTART CONTROLLING PART
13

AIR-FUEL RATIO CONTROL DEVICE FOR INTERNAL COMBUSTION ENGINE

BACKGROUND OF THE INVENTION

1. Field of the Invention

The present invention relates to an air-fuel ratio control technique for an internal combustion engine.

2. Description of the Background Art

Generally, an exhaust path of an internal combustion engine is provided with a three-way catalyst for simultaneously cleaning HC, CO, and $NO_x$ contained in the exhaust gas. With this catalyst, a high conversion ratio is obtained in the vicinity of a predetermined air-fuel ratio (theoretical air-fuel ratio) for all of HC, CO, and $NO_x$. For this reason, an oxygen concentration sensor is usually provided upstream of the catalyst so that an air-fuel ratio that is identified from its detection result is controlled to become close to the theoretical air-fuel ratio.

However, the oxygen concentration sensor provided upstream of the catalyst causes characteristic fluctuations (errors) since it is exposed to high exhaust temperatures; in view of this, there has been proposed a control device for an internal combustion engine in which an oxygen concentration sensor is also provided downstream of the catalyst so that errors can be corrected according to output values from the oxygen concentration sensor downstream of the catalyst (see, for example, Japanese Patent Application Laid-Open No. 6-42387 (1994)). In other words, in the device proposed in the foregoing publication, the oxygen concentration sensors are disposed both upstream and downstream of the catalyst to control the air-fuel ratio so that the atmosphere in the catalyst is maintained in the vicinity of the theoretical air-fuel ratio.

In the device proposed in the foregoing publication, a proportional operation and an integral operation are performed based on the result of comparison between an output from the oxygen concentration sensor and a target value concerning the downstream side of the catalyst, whereby the target value for the upstream side of the catalyst is corrected, and a fuel supply amount to an internal combustion engine is controlled by using a proportional operation and an integral operation so that the output of an oxygen concentration sensor and a target value match each other concerning the upstream side of the catalyst. Thus, it is possible to prevent tracking delays in the controlling and excessive corrections.

Further, in the device proposed in the foregoing publication, when the internal combustion engine enters a transient state due to a sudden closure of the throttle valve or the like, it stops the integral operation concerning the downstream side of the catalyst from the time of switching to the transient state to the lapse of a predetermined period. At this time, the integral value obtained by the integral operation is maintained at a value obtained immediately before entering the transient state, thereby suppressing the excessive correction of the target value of the air-fuel ratio regarding the upstream, which is caused when leaving the transient state. That is, it is possible to suppress the deviation of the air-fuel ratio caused by the transient state.

The above-mentioned catalyst provided in the exhaust path of the internal combustion engine has a capability of storing oxygen according to the oxygen concentration in the exhaust gas (oxygen storage capability) in order to compensate the temporary deviation of the air-fuel ratio in the internal combustion engine from the theoretical air-fuel ratio. Because of the oxygen storage capability, if the air-fuel ratio is leaner than the theoretical air-fuel ratio, the catalyst takes in the oxygen in the exhaust gas and stores it, whereas if the air-fuel ratio is richer than the theoretical air-fuel ratio, the catalyst discharges the oxygen stored therein. As a result, the atmosphere in the catalytic converter is maintained in the vicinity of the theoretical air-fuel ratio. However, when the fluctuation of the air-fuel ratio is great in the transient state and the amount of oxygen storage reaches zero or the upper limit value, the atmosphere in the catalyst is no longer maintained in the vicinity of the theoretical air-fuel ratio, deviating greatly from the theoretical air-fuel ratio.

As described above, three-way catalysts show high conversion ratios for all of HC, CO, and $NO_x$ in exhaust gases in the vicinity of the theoretical air-fuel ratio, and the conversion ratios become highest when the amount of oxygen storage is at an appropriate amount, about half of the upper limit value. In addition, the amount of oxygen storage of a catalyst can be detected from a very small variation of the air-fuel ratio in the downstream of the catalyst, which is in the vicinity of the theoretical air-fuel ratio. Accordingly, by controlling the air-fuel ratio of the upstream side of the catalyst according to values detected by the oxygen concentration sensor in the downstream side of the catalyst, the amount of oxygen storage can be controlled to be an appropriate amount and the conversion ratio of the catalyst can be kept high.

Nevertheless, the function of oxygen storage in catalyst serves as a cause of response delays in the air-fuel ratio control. Specifically, even when the air-fuel ratio of the upstream of the catalyst is changed to be richer or leaner by a feedback control, the air-fuel ratio of the downstream of the catalyst does not correspond immediately but changes after the amount of oxygen storage in the catalyst has changed.

Thus, if the integral operation concerning the downstream of the catalyst is restarted after the lapse of a certain time from a time of transition to a state in which the fuel supply to the internal combustion engine is stopped (a fuel cutoff state) without taking the behavior of the amount of oxygen storage into consideration, as the device proposed in the foregoing publication, problems arise such as malfunctions (excessive corrections) in the feedback control and impairing of its primary function. As a result, the air-fuel ratio after the fuel cutoff tends to deviate from the theoretical air-fuel ratio, leading to deterioration of emissions or the like.

SUMMARY OF THE INVENTION

It is an object of the invention to provide an air-fuel ratio control technique for internal combustion engines that is capable of suppressing deterioration of emissions or the like after a fuel cutoff.

In accordance with the instant invention, an air-fuel ratio control device for an internal combustion engine includes an upstream detector part, a downstream detector part, an air-fuel-ratio adjusting part, a control part, a target-value varying part, a state-detecting part, a cumulative-amount detecting part and a stop/restart part. The upstream detector part is provided in an exhaust system of the internal combustion engine, and detects a concentration of a particular component in an exhaust gas in an upstream side of a catalytic converter for cleaning the exhaust gas. The downstream detector part is provided in the exhaust system, and detects a concentration of a particular component in the exhaust gas in a downstream side of the catalytic converter. The air-fuel-ratio adjusting part adjusts an air-fuel ratio by controlling a fuel supply amount to the internal combustion engine. The control part controls the air-fuel-ratio adjusting part so that an output value of the upstream detector part and an upstream target value match each other. The target-value varying part changes the upstream target value using a proportional operation and an integral operation so that an output value of the downstream detector part and a downstream target value match each other. The state-detecting part detects a fuel cutoff state in which a fuel supply to the internal combustion engine is stopped. The cumulative-amount detecting part detects a cumulative amount of air taken into the internal combustion engine from a time at which the fuel cutoff state is removed. The stop/restart part stops the integral operation in response to detection of the fuel cutoff state by the state-detecting part, and restarts the integral operation in response to attainment of the cumulative air amount to a predetermined air amount.

While it is possible to suppress malfunctions in the feedback control of air-fuel ratio, and it is also possible to suppress deficiency in the function due to the halt of the integral operation. As a result, the air-fuel ratio after the fuel cutoff can be controlled at an appropriate value, and therefore, deterioration of emissions or the like after the fuel cutoff can be suppressed.

In accordance with the instant invention, an air-fuel ratio control device for an internal combustion engine includes an upstream detector part, a downstream detector part, an air-fuel-ratio adjusting part, a control part, a target-value varying part, a state-detecting part, and a stop/restart part. The upstream detector part is provided in an exhaust system of the internal combustion engine, and detects a concentration of a particular component in an exhaust gas in an upstream side of a catalytic converter for cleaning the exhaust gas. The downstream detector part is provided in the exhaust system, and detects a concentration of a particular component in the exhaust gas in a downstream side of the catalytic converter. The air-fuel-ratio adjusting part adjusts an air-fuel ratio by controlling a fuel supply amount to the internal combustion engine. The control part for controlling the air-fuel-ratio adjusting part so that an output value from the upstream detector part and an upstream target value match each other. The target-value varying part changes the upstream target value using a proportional operation and an integral operation so that an output value of the downstream detector part and a downstream target value match each other. The state-detecting part detects a fuel cutoff state in which a fuel supply to the internal combustion engine is stopped. The stop/restart part stops the integral operation in response to transition to the fuel cutoff state, and restarts the integral operation in response to a match between the output value of the downstream detector part and the downstream target value after removal of the fuel cutoff state.

Since it is possible to suppress malfunctions in the feedback control of air-fuel ratio, the air-fuel ratio after a fuel cutoff can be controlled to be an appropriate value. As a result, it is possible to suppress deterioration of emissions or the like after the fuel cutoff.

These and other objects, features, aspects and advantages of the present invention will become more apparent from the following detailed description of the present invention when taken in conjunction with the accompanying drawings.

BRIEF DESCRIPTION OF THE DRAWINGS

FIG. 2 is a block diagram showing a functional configuration of the air-fuel ratio control device 100;

DESCRIPTION OF THE PREFERRED EMBODIMENTS

Hereinbelow, preferred embodiments of the present invention are described with reference to the drawings.

<Outline of Air-fuel Ratio Control Device>

Figure 1:
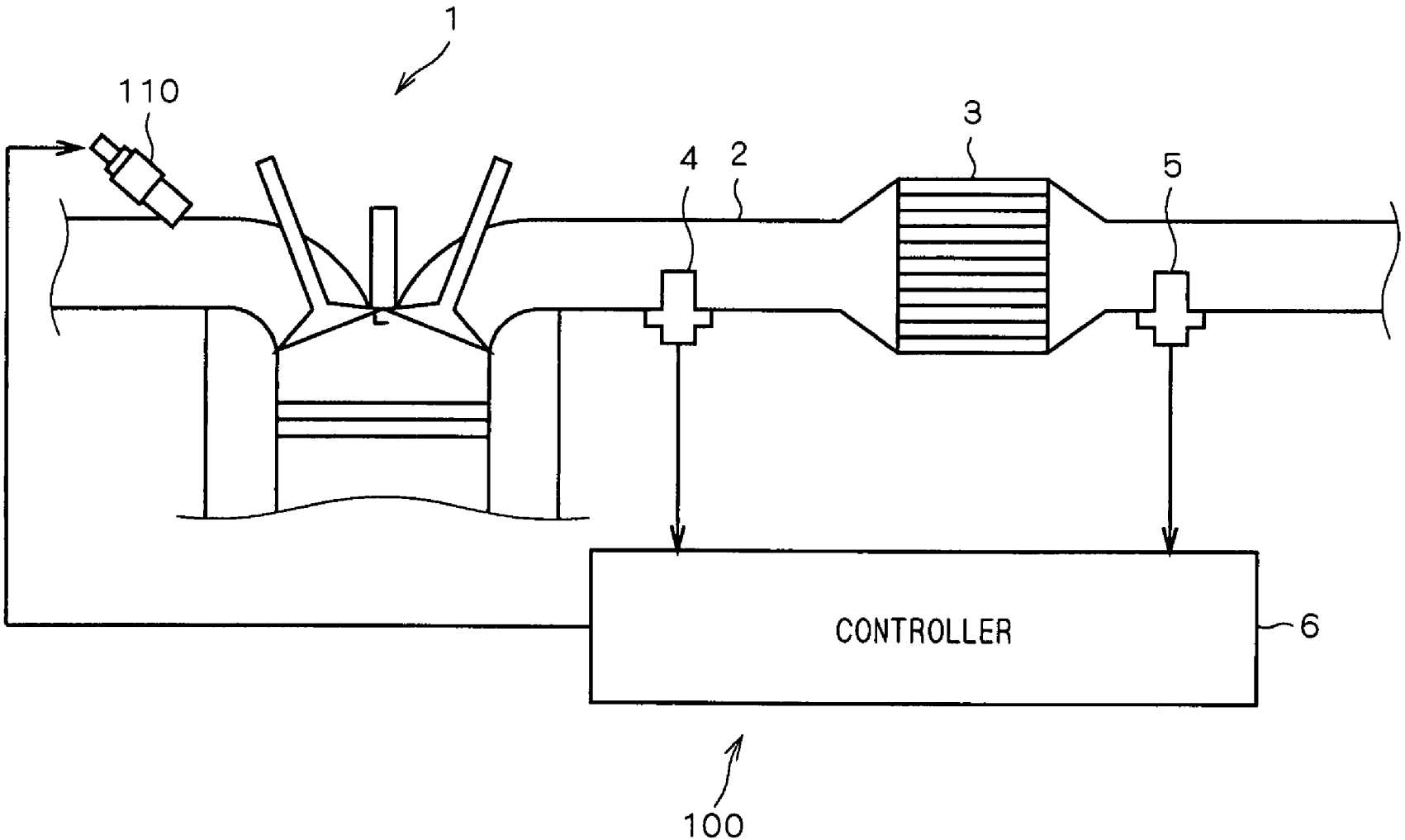
FIG. 1 is a schematic view showing the outline of an air-fuel ratio control device 100 according to one preferred embodiment of the present invention.

FIG. 1 is a schematic view showing the outline of an air-fuel ratio controlling device 100 according to one preferred embodiment of the present invention.

As shown in FIG. 1, an air-fuel ratio control device 100 is a device for controlling the ratio of air and fuel (air-fuel ratio) that are supplied to an engine 1, which is an internal combustion engine. The air-fuel ratio control device 100 is equipped with oxygen concentration sensors 4 and 5, and a controller 6.

An exhaust pipe 2 of the engine 1 is provided with a catalytic converter 3 for cleaning an exhaust gas emitted from the engine 1. The catalytic converter 3 is configured using a three-way catalyst which has a predetermined air-fuel ratio (theoretical air-fuel ratio) at which conversion ratios are high for any of HC, CO, and $NO_x$. The oxygen concentration sensor 4 (hereinafter also referred to as an "upstream oxygen sensor") is provided upstream of the catalytic converter 3 in the exhaust pipe 2. Also, the oxygen concentration sensor 5 (hereinafter also referred to as a "downstream oxygen sensor") is provided downstream of the catalytic converter 3 in the exhaust pipe 2.

The controller 6 is equipped with a microprocessor, a ROM, a RAM, an I/O interface, and so forth; it controls air-fuel ratios by adjusting the amount of fuel supplied from a fuel injecting valve 110 to the engine 1 based on the outputs from the upstream and downstream oxygen sensors 4 and 5.

FIG. 2 is a block diagram showing a functional configuration of the air-fuel ratio control device 100.

The controller 6 achieves various functions by reading various programs, which are stored within a ROM or the like, into a microprocessor. It should be noted that, for simplicity in illustration, FIG. 2 shows the functions realized by the controller 6 as if they are physical structures.

As shown in FIG. 2, the controller 6 is provided with, as its functions, an air-fuel-ratio adjusting part 7, a fuel-supply-amount correcting-coefficient calculating part 8, an upstream target-value varying part 9, a downstream target-value setting part 10, a fuel-cutoff detecting part 11, a cumulative-air-intake-amount detecting part 12, and an integral-operation-stop/restart controlling part 13.

The air-fuel-ratio adjusting part 7 adjusts air-fuel ratios by controlling the fuel supplied to the engine 1 based on a fuel-supply-amount correcting-coefficient (the coefficient for correcting the amount of the fuel supplied to the engine 1) that is input from the fuel-supply-amount correcting-coefficient calculating part 8. Specifically, a control signal is sent from the air-fuel-ratio adjusting part 7 to a driving circuit 111 of a fuel injecting valve so that the driving of the fuel injecting valve 110 is controlled; thereby, the amount of fuel supplied to the engine 1 (fuel supply amount) is adjusted.

On receiving an output from the upstream oxygen sensor 4, the fuel-supply-amount correcting-coefficient calculating part 8 calculates a fuel-supply-amount correcting-coefficient so that the output value from the upstream oxygen sensor 4 matches a target value of the air-fuel ratio for the upstream side (hereinafter also referred to as an "upstream-side target value"), and outputs the fuel-supply-amount correcting-coefficient to the air-fuel-ratio adjusting part 7. In other words, the fuel-supply-amount correcting-coefficient calculating part 8 controls the air-fuel-ratio adjusting part 7 by outputting the fuel-supply-amount correcting-coefficient.

On receiving an output from the downstream oxygen sensor 5, the upstream target-value varying part 9 changes the upstream target value using a proportional operation and an integral operation so that an output value from the downstream oxygen sensor 5 matches a target value of the air-fuel ratio for the downstream side (hereinafter also referred to as a "downstream-side target value") that is set by the downstream target-value setting part 10. The upstream-side target value that has been changed is output to the fuel-supply-amount correcting coefficient calculating part 8.

The downstream target-value setting part 10 sets an output value of the downstream oxygen sensor 5 that corresponds to the theoretical air-fuel ratio as a downstream target value based on an operation performed by a user with an operation part (not shown) and various data stored in a ROM, and stores it in a RAM or the like.

The fuel-cutoff detecting part 11 detects whether or not the operating state is in a state in which the fuel supply to the engine 1 is stopped (hereinafter also referred to as a "fuel cutoff state"). In other words, it can detect transition to a fuel cutoff state.

The cumulative-air-intake-amount detecting part 12 detects a cumulative value of the amount of air that is taken into the engine 1 (air intake amount) from a time at which the fuel cutoff state detected by the fuel-cutoff detecting part 11 is removed (a time when reverting from the fuel cutoff state). (The cumulative value is hereinafter also referred to as a "cumulative air amount".)

The integral-operation-stop/restart controlling part 13 stops (interrupts) an integral operation in the upstream target-value varying part 9 in response to detection of the fuel cutoff state by the fuel-cutoff detecting part 11. In other words, it can stops the integral operation in response to the transition to the fuel cutoff state. Then, after the fuel cutoff state is removed, it restarts the integral operation in the upstream target-value varying part 9 in response to the cumulative air amount detected by the cumulative-air-intake-amount detecting part 12 that has reached at a predetermined particular amount.

<Basic Operation of Air-Fuel Ratio Control>

The upstream and downstream oxygen sensors 4 and 5 acquire information for specifying the air-fuel ratio in the exhaust pipe 2 by respectively detecting the concentrations of oxygen, which is a specific component in the exhaust gas in the upstream and the downstream of the catalytic converter 3.

Figure 3:
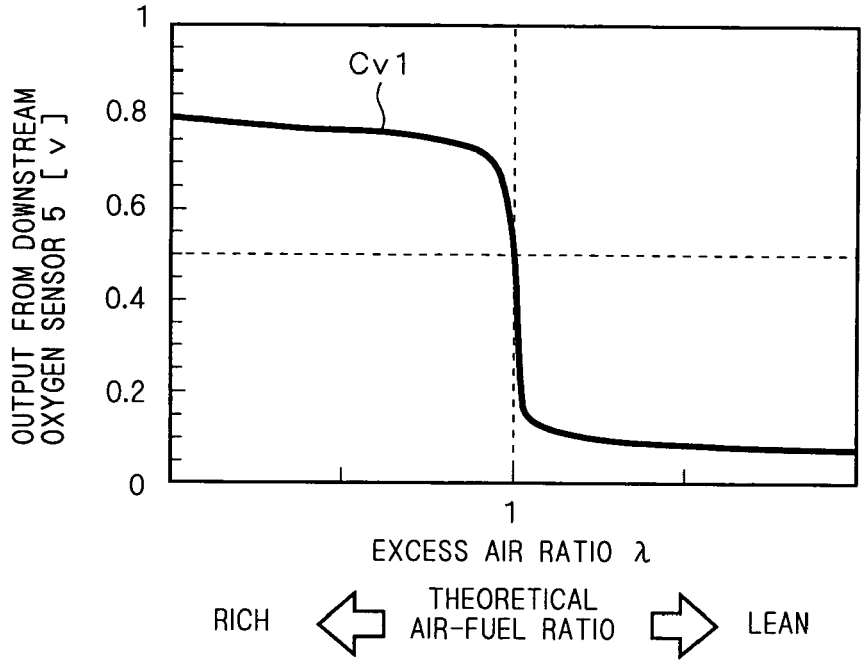
FIG. 3 is a graph for illustrating the output profile of a downstream oxygen sensor 5.

FIG. 3 is a graph for illustrating the output profile of the downstream oxygen sensor 5, in which the vertical axis represents output values, the horizontal axis represents the theoretical air-fuel ratio (excess air ratios λ), and a curve Cv1 represents the output profile. As for the horizontal axis, when an excess air ratio λ=1, it means the theoretical air-fuel ratio; the air-fuel ratio is richer toward the left side of the figure, whereas the air-fuel ratio is leaner toward the right side of the figure.

As shown in FIG. 3, a λ-type oxygen concentration sensor, in which the output abruptly changes in the vicinity of the theoretical air-fuel ratio with respect to the change in the air-fuel ratio and shows a substantially binary output toward and past the theoretical air-fuel ratio, is employed for the downstream oxygen sensor 5. The output value that is input from the downstream oxygen sensor 5 to the controller 6 is input to the upstream target-value varying part 9 as an output value indirectly representing the air-fuel ratio at the current time (hereinafter referred to as a "downstream air-fuel-ratio output value").

The downstream target-value setting part 10 sets a downstream target value to be in the vicinity of a predetermined output value of the downstream oxygen sensor (λ-type oxygen concentration sensor) 5 that corresponds to the theoretical air-fuel ratio (0.5 V herein), and outputs the downstream target value to the upstream target-value varying part 9.

The upstream target-value varying part 9 obtains a deviation between the downstream target value and the downstream air-fuel-ratio output value by computation, and performs a PI control, in which a proportional operation (hereinafter also referred to as a "P operation") and an integral operation (hereinafter also referred to as an "I operation") are performed according to the deviation. In this PI control, a proportional value obtained by the proportional operation (hereinafter also referred to as a "downstream proportional value") an integral value obtained by the integral operation (hereinafter also referred to as a "downstream-side integral value") are calculated. Then, the upstream target value is changed and set so that the deviation will be eliminated, and the upstream target value that has been changed is output to the fuel-supply-amount correcting-coefficient calculating part 8. For this technique of the PI control, the same technique as described in Japanese Patent Application Laid-Open No. 6-42387 (1994) may be employed except for the later-described timing for restarting the integral operation.

It should be noted here that the integral operation shows comparatively slow response characteristics because it produces outputs by time integrating the deviation, and it serves to eliminate a constant output deviation (characteristic fluctuation) of the upstream oxygen sensor 4 by detecting it with the use of the downstream oxygen sensor 5. On the other hand, the proportional operation shows quick response characteristics because it produces outputs in proportional to the deviation at the time, and it serves to quickly eliminate the rapid deviation of the air-fuel ratio in the downstream of the catalytic converter 3 that is caused by the fluctuation in the air-fuel ratio in the upstream of the catalytic converter 3.

Figure 4:
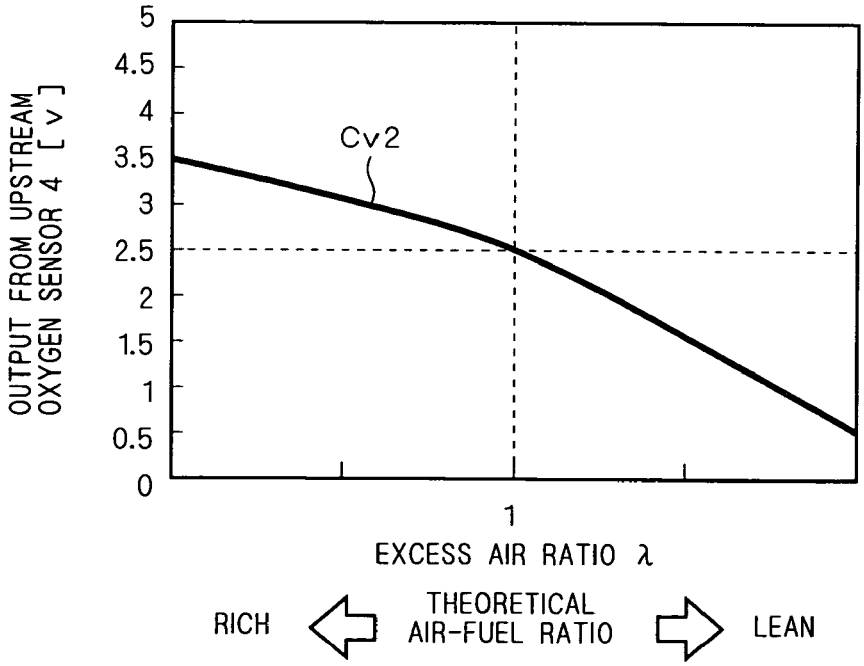
FIG. 4 is a graph for illustrating the output profile of an upstream oxygen sensor 4.

FIG. 4 is a graph for illustrating the output profile of an upstream oxygen sensor 4, in which, in a similar manner to FIG. 3, the vertical axis represents output values, the horizontal axis represents theoretical air-fuel ratio (excess air ratios λ), and a curve Cv2 represents the output profile. Regarding the horizontal axis, excess air ratio λ=1 indicates the theoretical air-fuel ratio; and the air-fuel ratio is richer toward the left side of the figure, whereas the air-fuel ratio is leaner toward the right side of the figure, also in a similar manner to FIG. 3.

As shown in FIG. 4, a linear-type oxygen concentration sensor, which has such an output profile that the output value changes almost linearly with respect to the change in the air-fuel ratio, is used for the upstream oxygen sensor 4. The output value that is input from the upstream oxygen sensor 4 to the controller 6 is input to the fuel-supply-amount correcting-coefficient calculating part 8 as an output value indirectly representing the air-fuel ratio (hereinafter also referred to as an "upstream air-fuel ratio output value").

The fuel-supply-amount correcting-coefficient calculating part 8 obtains a deviation between the upstream target value and the upstream air-fuel ratio output value by computation, and performs a PID control, in which a proportional operation, an integral operation, and a differentiation operation (hereinafter also referred to as a "D operation") are performed according to the deviation. In the PID control, a fuel-supply-amount correcting-coefficient is calculated and set so that the deviation between the upstream target value and the upstream air-fuel ratio output value will be eliminated, and the fuel-supply-amount correcting-coefficient is output to the air-fuel-ratio adjusting part 7.

Then, the air-fuel-ratio adjusting part 7 sets the amount of fuel supplied to the engine 1 according to the fuel-supply-amount correcting-coefficient, and the driving circuit 111 for the fuel injecting valve 110 accordingly performs open/close driving of the fuel injecting valve 110. Thus, the air-fuel ratio of the engine 1 is controlled.

<Oxygen Storage Capability and Associated Problems>

The catalytic converter 3 is provided with a capability of storing oxygen (oxygen storage capability) according to the oxygen concentration in an exhaust gas in order to compensate a temporary deviation of the air-fuel ratio from the theoretical air-fuel ratio. This oxygen storage capability originates from addition of a substance having oxygen storage capability to the catalytic converter 3, and the design of the addition amount of the substance determines the upper limit value of the amount of accumulated oxygen (amount of oxygen storage).

As described above, with this oxygen storage capability, the catalytic converter takes in and stores the oxygen contained in the exhaust when the air-fuel ratio is leaner than the theoretical air-fuel ratio, and thereby maintains the atmosphere in the catalytic converter in the vicinity of the theoretical air-fuel ratio until the amount of oxygen storage saturates. On the other hand, the catalytic converter emits the oxygen stored therein when the air-fuel ratio is richer than the theoretical air-fuel ratio, and thereby the atmosphere within the catalytic converter is maintained in the vicinity of the theoretical air-fuel ratio until the stored oxygen runs out with it being consumed. Therefore, even if the air-fuel ratio of the engine 1 fluctuates, becoming leaner or richer than the theoretical air-fuel ratio, the atmosphere within the catalytic converter can be maintained in the vicinity of the theoretical air-fuel ratio as the amount of oxygen storage of the catalytic converter changes.

Specifically, when the air-fuel ratio is slightly leaner than the theoretical air-fuel ratio, the amount of oxygen storage becomes near the upper limit value; on the other hand, when the air-fuel ratio is richer than the theoretical air-fuel ratio, the amount of oxygen storage becomes near zero. When the air-fuel ratio is in the vicinity of the theoretical air-fuel ratio, the amount of oxygen storage becomes about half the amount of the upper limit value. However, in the case where the operation state of the engine 1 is such that the fluctuation of the air-fuel ratio is large in the transient state and the amount of oxygen storage has reached zero or the upper limit value, the atmosphere in the catalytic converter 3 is no longer maintained in the vicinity of the theoretical air-fuel ratio, deviating from the theoretical air-fuel ratio greatly.

Although this catalytic converter 3 shows high conversion ratios for all of HC, CO, and $NO_x$ in exhaust gases in the vicinity of the theoretical air-fuel ratio, the conversion ratios become highest when the amount of oxygen storage is at an appropriate amount, about half of the upper limit value. Moreover, the amount of oxygen storage of the catalytic converter 3 can be detected from a very small change in the air-fuel ratio in the downstream of the catalytic converter 3 in the vicinity of the theoretical air-fuel ratio. For this reason, the amount of oxygen storage can be controlled at an appropriate amount and the conversion ratio of the catalytic converter 3 can be kept high by controlling the air-fuel ratio in the upstream of the catalytic converter 3 according to the downstream air-fuel-ratio output value that is output by the downstream oxygen sensor 5.

Nevertheless, the function of oxygen storage works as a response delay in the air-fuel ratio control, and therefore, even if the air-fuel ratio in the upstream of the catalytic converter 3 is changed to be richer or leaner, the air-fuel ratio in the downstream of the catalytic converter 3 does not correspond thereto immediately but changes after the change of amount of oxygen storage. Consequently, when the air-fuel ratio in the downstream of the catalytic converter 3 shifts toward a lean side from the theoretical air-fuel ratio because of a fuel cutoff, a time delay occurs until the air-fuel ratio in the downstream of the catalytic converter 3 reverts to the theoretical air-fuel ratio even if the air-fuel ratio of the catalytic converter 3 is varied to be richer by a proportional operation. This time delay is dependent on the behavior of amount of oxygen storage.

Here, the behavior of amount of oxygen storage is discussed.

Amount of oxygen storage (AOS) can be calculated comparatively accurately from the following expressions (1) and (2), according to the descriptions in Japanese Patent Application Laid-Open Nos. 2000-120475, 5-195842 (1993), and so forth.

$$AOS=\Sigma(\Delta A/F\times KO2\times qa\times\Delta T) \quad (1)$$

$$0\leqq AOS\leqq(\text{upper limit value of amount of oxygen storage}) \quad (2)$$

In the above expressions (1) and (2), ΔA/F represents a deviation of air-fuel ratio in the upstream of the catalytic converter 3 from the theoretical air-fuel ratio (Δair-fuel ratio), KO2 represents a predetermined coefficient for converting air-fuel ratio into oxygen concentration, qa represents an intake amount of air that is taken into an internal combustion engine, and ΔT represents an operation cycle. It should be noted that the behavior of amount of oxygen storage (AOS) is dependent on changes of ΔA/F and qa because ΔT and KO2 are set at predetermined values in advance. In addition, because the amount of oxygen storage (AOS) has an upper limit value, amount of oxygen storage is restricted by the upper limit value and the minimum value 0, as will be appreciated from the above expression (2).

An air intake amount (qa) of air that is taken into an internal combustion engine (i.e., the engine 1) can be detected by one of the following information (i) to (iv): (i) signal information from an air amount sensor (not shown) provided upstream of a throttle valve (not shown); (ii)

opening-degree information of a throttle valve (not shown), (iii) signal information from a pressure sensor (not shown) disposed downstream of the throttle valve, and (iv) information about the revolution number of the engine 1.

Here, at the time of a fuel cutoff, for example, the air-fuel ratio in the upstream of the catalytic converter 3 becomes considerably lean to such a degree as to correspond to approximately the normal air (atmosphere) outside the engine 1, and therefore the amount of oxygen storage changes to the upper limit value. Then, after reverting from the fuel cutoff, the upstream target value is set by varying it with the upstream target-value varying part 9 by means of only a proportional operation based on the output from the downstream oxygen sensor 5 so that the air-fuel ratio in the upstream of the catalytic converter 3 reverts to about half of the upper limit value, which is an appropriate amount.

It should be noted that, in the process in which the amount of oxygen storage reverts to an appropriate amount of about half of the upper limit value, the deviation of the air-fuel ratio in the downstream of the catalytic converter 3 from the theoretical air-fuel ratio stays at approximately the same value. Therefore, an adjusting amount of the air-fuel ratio in the upstream of the catalytic converter 3 that is determined based on the proportional operation according to the deviation, and ΔA/F result in approximately the same during this process.

However, even if ΔA/F stays the same, the rate of change of amount of oxygen storage changes in proportional to the amount of air intake amount qa according to the expression (1). Therefore, the speed at which the amount of oxygen storage having undergone the disturbance by the fuel cutoff reverts to the appropriate amount of oxygen storage of about half of the upper limit value is in proportional to the air intake amount qa. Also, since the amount of variation of amount of oxygen storage is in proportional to the cumulative amount of air intake amount qa, a period in which the amount of oxygen storage having reached the upper limit value because of the fuel cutoff reverts to the appropriate amount of oxygen storage matches a period in which the cumulative amount of air intake amount becomes a predetermined amount (hereinafter also referred to as a "predetermined air amount").

Nevertheless, the air intake amount qa greatly varies depending on the operating state of the internal combustion engine, such as an opening degree of a throttle valve (not shown). For example, when the throttle valve opening degree is minimum, the air intake amount qa becomes a minimum flow rate of about 4 g/s; on the other hand, when the throttle valve opening degree is maximum, the air intake amount qa becomes a maximum flow rate of about 70 g/s, showing a change of about 10 times or more. Thus, the time for the cumulative amount of the air intake amount qa to change to a predetermined air amount greatly varies depending on a change of the air intake amount qa.

Consequently, if the integral operation concerning the downstream of the catalytic converter is restarted after a certain time from the time of a fuel cutoff state without taking the behavior of amount of oxygen storage into consideration as in the device proposed in Japanese Patent Application Laid-Open No. 6-42387 (1994), problems arise such as malfunctions in the feedback control (excessive correction) and impairing of its primary function.

Specifically, when the halt time of the integral operation is insufficient (too short), the integral operation is restarted before the amount of oxygen storage stabilizes, causing malfunctions. On the other hand, when the halt time of the integral operation is in excess (too long), the restart of the integral operation after the amount of oxygen storage has stabilized is delayed and the execution time of the integral operation becomes short, causing problems in the primary function (the function for matching air-fuel ratios to target values). As a result, the air-fuel ratio after the fuel cutoff tends to deviate from the theoretical air-fuel ratio, leading to deterioration of emissions or the like.

In view of the foregoing, the air-fuel ratio control device 100 according to a preferred embodiment of the present invention suppresses deterioration of emissions or the like by controlling air-fuel ratios taking the behavior of amount of oxygen storage into consideration, as will be described below.

<Air-Fuel Ratio Control Operation Taking Amount of Oxygen Storage into Consideration>

As has been described above, a period from the time the amount of oxygen storage reaches the upper limit value due to the fuel cutoff to the time it reverts to an appropriate amount matches a period in which the cumulative amount (cumulative air amount) Qa of the air intake amount qa becomes a predetermined air amount Xqa after returning from the fuel cutoff state. For this reason, if the predetermined air amount Xqa is set in advance and the integral operation in the upstream target-value varying part 9 is restarted at the time when the cumulative air amount Qa matches the predetermined air amount Xqa, it becomes possible to suppress malfunctions in the feedback control (excessive corrections), impairing of its primary function, and the like.

First, the following describes how to obtain a predetermined air amount Xqa.

A predetermined air amount Xqa substantially matches a cumulative air amount at the time the air-fuel ratio in the downstream of the catalytic converter 3 stabilizes in the vicinity of the downstream target value after returning from the fuel cutoff state. For this reason, a predetermined air amount Xqa can be experimentally obtained as follows; with a similar configuration to the air-fuel ratio control device 100, the amount of oxygen storage of the catalytic converter 3 is changed to the upper limit value by cutting off a fuel, and after returning from the fuel cutoff state, a cumulative air amount Qa at which the air-fuel ratio in the downstream of the catalytic converter 3 stabilizes in the vicinity of the downstream target value is detected while the upstream target-value varying part 9 is performing only the proportional operation. The present preferred embodiment adopts, as one example, a method in which a cumulative air amount Qa at a time at which the air-fuel ratio in the downstream of the catalytic converter 3 matches the downstream target value from the time of removal of the fuel cutoff state is experimentally obtained as a predetermined air amount Xqa while the upstream target-value varying part 9 is performing only the proportional operation. It should be noted that the upper limit value of the amount of oxygen storage in the catalytic converter 3 is determined according to the addition amount of a substance having oxygen storage capability, that is, according to its design, and therefore, it is possible to obtain a predetermined air amount Xqa by calculation using the above equation (1).

Next, the following describes operations in the fuel-cutoff detecting part 11, the cumulative-air-intake-amount detecting part 12, and the integral-operation-stop/restart controlling part 13, which are for controlling the stop and restart of the integral operation in the upstream target-value varying part 9.

The fuel-cutoff detecting part 11 detects (determines) whether or not the operating state is in a state in which the supply of fuel to the engine 1 is cut off (fuel cutoff state). The fuel-cutoff detecting part 11 detects (determines) that the operating state is in a fuel cutoff state when a supply amount of fuel to the engine 1 (fuel supply amount) that is controlled in the air-fuel-ratio adjusting part 7 is set at zero and the fuel supply to the engine 1 is stopped. Conversely, it detects (determines) that the operating state is not in a fuel cutoff state when the fuel supply to the engine 1 is not stopped. It should be noted that a conceivable case in which the operating state is in a fuel cutoff state is such a case that the opening degree of a throttle valve becomes zero. Then, the detection (determination) result in the fuel-cutoff detecting part 11 is output to the cumulative-air-intake-amount detecting part 12 and the integral-operation-stop/restart controlling part 13.

Figure 5:
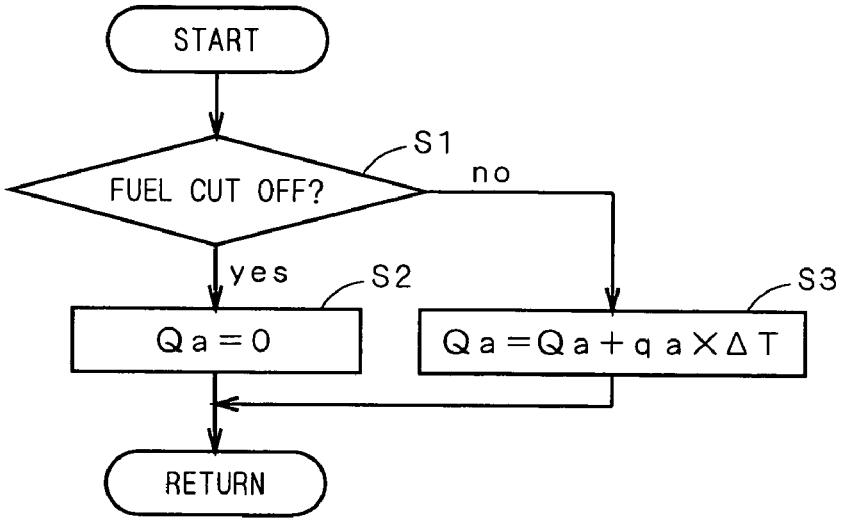
FIG. 5 is a flow-chart showing a calculation process flow for cumulative air amount Qa.

FIG. 5 is a flow-chart showing a detection process flow for a cumulative air amount in the cumulative-air-intake-amount detecting part 12. This flow, which includes the following steps S1 to S3, is executed at all times while the air-fuel ratio control is being performed, and is carried out by repeating a series of flow made up of steps S1 to S3 at each operation cycle ΔT in which an air intake amount qa is added up.

First, at step S1, it is determined whether or not a fuel cutoff state is detected by the fuel-cutoff detecting part 11. Here, if a fuel cutoff state is detected, the process proceeds to step S2, at which the cumulative air amount Qa is reset to zero (step S2), and the process returns to step S1. On the other hand, if a fuel cutoff state is not detected, the process proceeds to step S3, in which the cumulative air amount Qa is incremented by a product of the air intake amount qa and the operation cycle ΔT. Through such an operation, the cumulative-air-intake-amount detecting part 12 detects a cumulative air amount Qa. The cumulative air amount Qa detected by the cumulative-air-intake-amount detecting part 12 is output to the integral-operation-stop/restart controlling part 13.

In other words, such a configuration makes the following possible: a fuel cutoff state is entered; the cumulative air amount Qa is reset to zero when in the fuel cutoff state; the adding up of an air intake amount qa is started from zero from the time of reverting to the fuel cutoff state; and the cumulative air amount Qa after the fuel cutoff is obtained.

Figure 6:
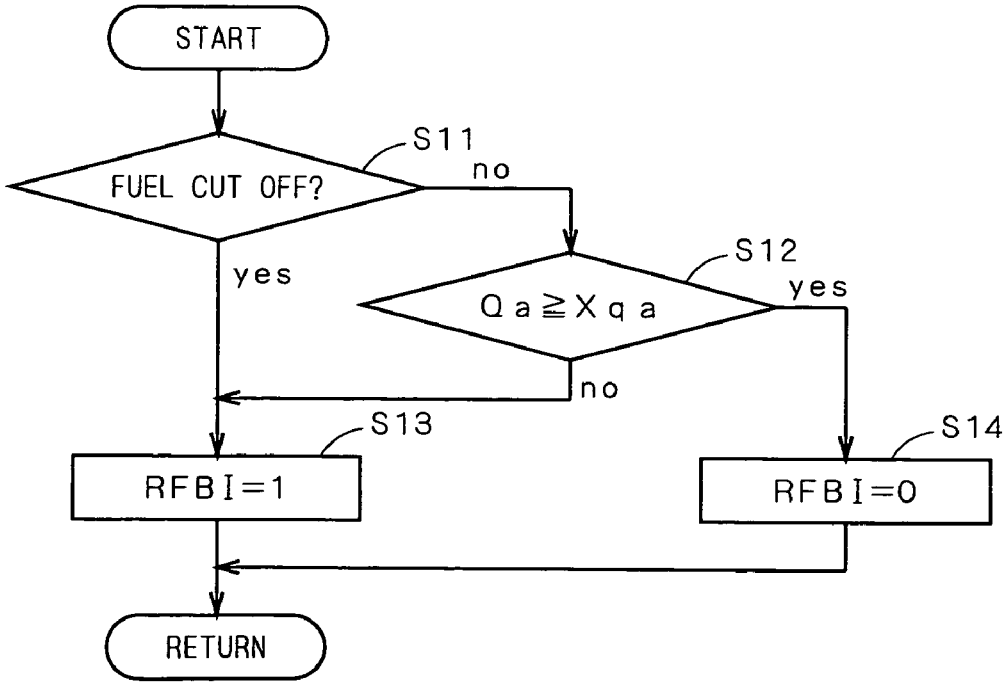
FIG. 6 is a flow-chart showing a stop/restart control flow of an integral operation.

FIG. 6 is a flow-chart showing a process flow for controlling the stop and restart of an integral operation in the integral-operation-stop/restart controlling part 13. This flow, which includes the following steps S11 to S14, is executed at all times while the air-fuel ratio control is being performed, and is carried out by repeating a series of flow made up of steps S11 to S14 at each operation cycle ΔT in which an air intake amount qa is added up.

First, at step S11, it is determined whether or not a fuel cutoff state detected by the fuel-cutoff detecting part 11. Here, if a fuel cutoff state is detected, the process proceeds to step S13, in which an integral operation stop determination flag (RFBI) is set to be 1 (step S13), and the process returns to step S11. On the other hand, if a fuel cutoff state is not detected, the process proceeds to step S12, in which it is determined whether or not a cumulative air amount Qa after the fuel cutoff is equal to or greater than a predetermined air amount Xqa (step S12).

At step S12, if the cumulative air amount Qa is equal to or greater than a predetermined air amount Xqa, the process proceeds to step S14, in which the integral operation stop determination flag (RFBI) is set to be zero (step S14), and the process returns to step S11. On the other hand, if the cumulative air amount Qa is not equal to or greater than a predetermined air amount Xqa, the process proceeds to step S13, in which the integral operation stop determination flag (RFBI) is set to be 1 (step S13), and the process returns to step S11. Here, the case in which the stop determination flag (RFBI) is 1 corresponds to the stop (interrupting) of the integral operation in the upstream target-value varying part 9, whereas the case in which the stop determination flag (RFBI) is zero corresponds to the execution (or restart) of the integral operation in the upstream target-value varying part 9.

Thus, in the integral-operation-stop/restart controlling part 13, it is possible to set the stop determination flag (RFBI) for controlling the stop (interruption) and restart of the integral operation. The information of the stop determination flag (RFBI) set by the integral-operation-stop/restart controlling part 13 is output to the upstream target-value varying part 9 as the information for ordering a stop or execution of the integral operation in the upstream target-value varying part 9.

According to the output of the information for ordering the stop or execution from the integral-operation-stop/restart controlling part 13, the upstream target-value varying part 9 stops or executes the integral operation. Specifically, if the stop determination flag (RFBI) is zero, which indicates an execution, the integral operation is executed and the integral values are updated in a time sequence. On the other hand, if the stop determination flag (RFBI) is 1, which indicates a stop, the integral operation is stopped and the integral value is retained without updating the integral value.

<Advantageous Effects Obtained by Air-Fuel Ratio Control Taking Oxygen Storage Capability into Consideration>

Here, advantageous effects obtained by the air-fuel ratio control device 100 according to the present embodiment are described with a comparison to conventional techniques.

Figure 7:
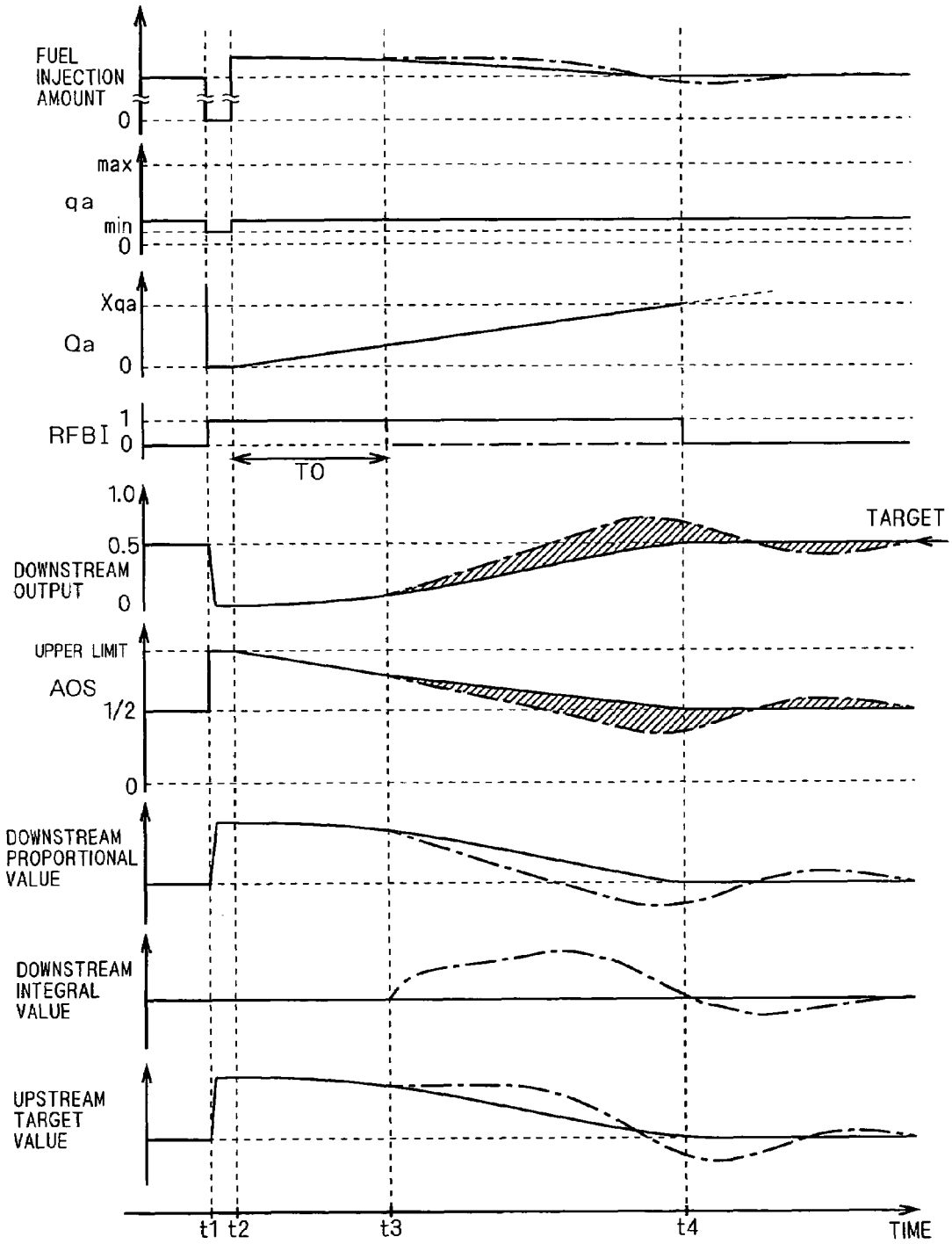
FIG. 7 is a timing chart concerning an air-fuel ratio control operation.
Figure 8:
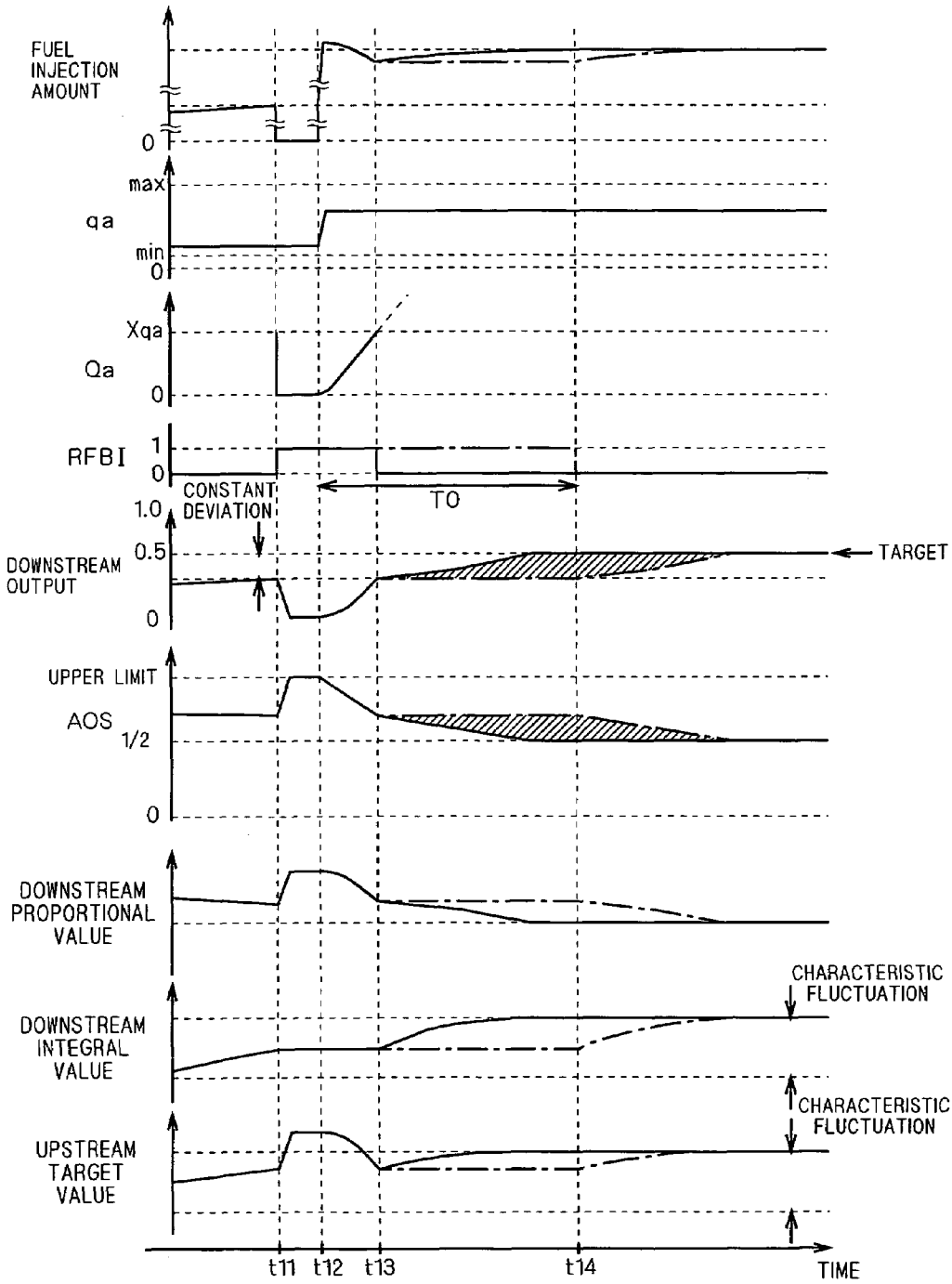
FIG. 8 is a timing chart concerning an air-fuel ratio control operation.

FIGS. 7 and 8 are timing charts concerning air-fuel ratio control operations. In each of FIGS. 7 and 8, the solid lines represent changes of the following values before and after a fuel cutoff: fuel injection amount, air intake amount qa, cumulative air amount Qa, stop determination flag (RFBI), downstream air-fuel ratio output, amount of oxygen storage (AOS), downstream proportional value, downstream integral value, and upstream target value, in order from the top of the figures.

In addition, FIG. 7 shows a case in which the air intake amount qa before and after the fuel cutoff is relatively small, and FIG. 8 shows a case in which the air intake amount qa after the fuel cutoff is relatively larger than that before the fuel cutoff.

Further, in FIGS. 7 and 8, the dash-dotted lines represent, for the purpose of comparison, the change of each of the values in a case in which the time of restarting the integral operation is assumed to be such that the integral operation in the upstream target-value varying part 9 is restarted after the lapse of a certain time from the time of shifting to a fuel cutoff state without taking the behavior of amount of oxygen storage into consideration (hereinafter also referred to as a "comparative example"), as in the device proposed in Japanese Patent Application Laid-Open No. 6-42387 (1994). As for the changes of the downstream air-fuel ratio output and the amount of oxygen storage (AOS), the differences between the values with the present preferred embodiment and the values with the comparative example are shown by the hatched areas.

First, the changes of the values in the comparative example (dash-dotted lines) shown in FIG. 7 are discussed.

Fuel injection amount temporarily becomes zero due to a fuel cutoff (time t1); then, until the lapse of a predetermined period T0 that has been set in advance from the reversion from the fuel cutoff state at time t2 (time t2–t3), the upstream target-value varying part 9 performs only the proportional operation and stops the integral operation, retaining the downstream integral value. Then, at the time t3, the integral operation in the upstream target-value varying part 9 is restarted after the lapse of the predetermined period T0. At this time, the amount of oxygen storage (AOS) has not reverted to about half of the upper limit value, which is an appropriate amount, and the downstream air-fuel-ratio output value results in a considerably lower value than the downstream target value that corresponds to the theoretical air-fuel ratio. As a consequence, a large deviation occurs between the downstream target value and the downstream air-fuel-ratio output value; the downstream integral value greatly increases so as to keep up with the deviation (time t3 to time t4), and the upstream target value is excessively corrected, causing the downstream air-fuel-ratio output value to deflect toward the rich side beyond the downstream target value. As a reaction thereto, after time t4 onward, the downstream air-fuel-ratio output value deflects toward the lean side beyond the downstream target value, and the downstream air-fuel-ratio output value does not stabilize to the downstream target value even after a long time has elapsed following the reversion from the fuel cutoff state. As a result, emission deteriorates considerably.

In contrast, with the air-fuel ratio control device 100 according to the present preferred embodiment, the upstream target-value varying part 9 performs only the proportional operation and stops the integral operation, retaining the downstream integral value, until the cumulative air amount Qa reaches the predetermined air amount Xqa after the reversion from the fuel cutoff state at the time t2 (time t2–t4), as represented by the solid lines in FIG. 7. Then, at the time t4, the amount of oxygen storage (AOS) has reverted to about half of the upper limit value, which is an appropriate amount, and the downstream air-fuel-ratio output value becomes a downstream target value that approximately corresponds to the theoretical air-fuel ratio. Therefore, even when the integral operation of the upstream target-value varying part 9 is restarted at the time t4, almost no deviation occurs between the downstream target value and the downstream air-fuel-ratio output value, and consequently, the upstream target value is not excessively corrected. As a result, it is possible to suppress deterioration of emissions or the like after the fuel cutoff.

Next, FIG. 8 is explained.

The changes of the values represented in FIG. 8 are shown with the assumption that a characteristic fluctuation occurs in the upstream oxygen sensor 4 before a fuel cutoff. It is thought that the characteristic fluctuation of the upstream oxygen sensor 4 occurs in such cases where the exhaust temperature changes during an operation according to a change in operating conditions and where a constant characteristic fluctuation amount has developed due to deterioration over time and the downstream integral value is reset to an initial value (for example, 2.5 V) at the time of a stop of the operation. Also, it is thought that in a mechanism in which the downstream integral value is battery-backed up during the suspension of the operation, the downstream integral value may be reset to an initial value when resetting the battery.

FIG. 8 illustrates a case in which an operation to compensate the characteristic fluctuation by increasing the downstream integral value before a fuel cutoff is in progress, and the downstream air-fuel-ratio output value is less than the downstream target value immediately before the fuel cutoff.

Figure 9:
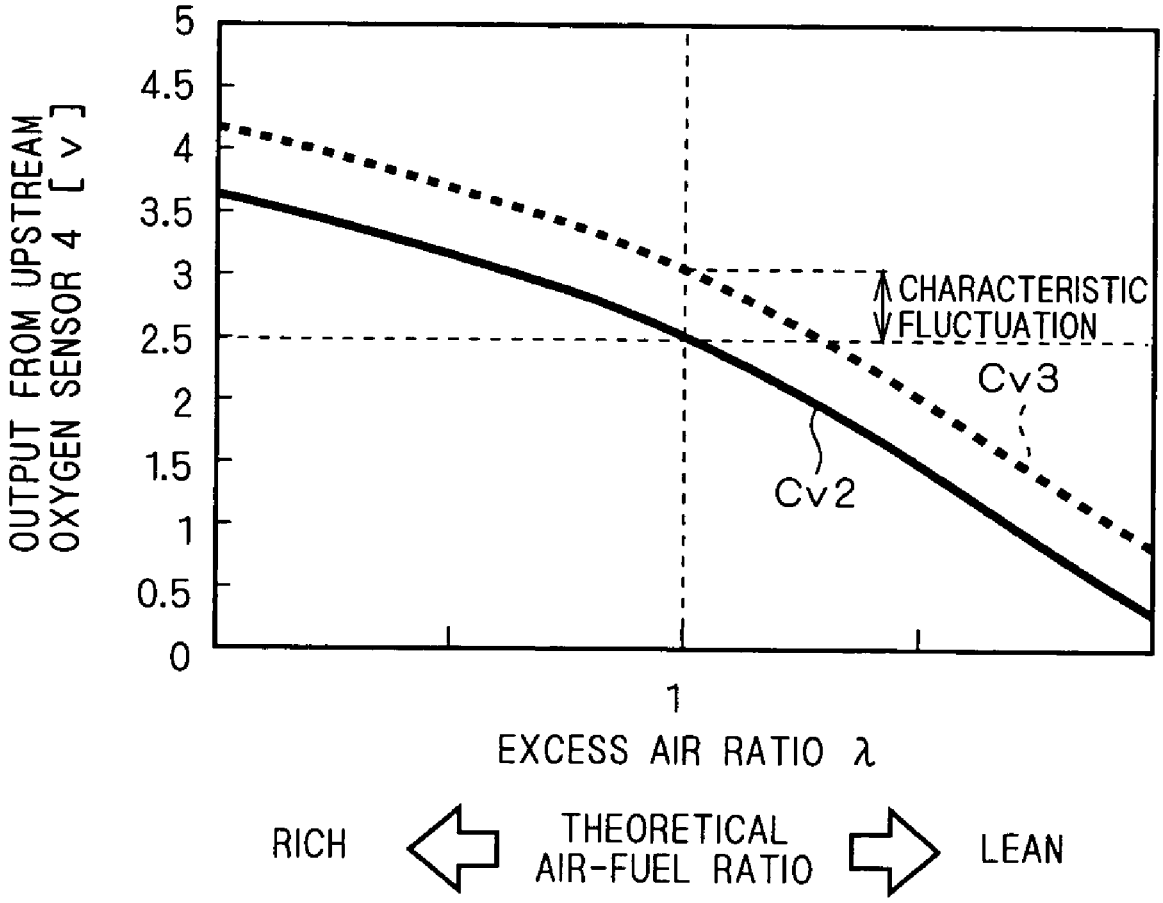
FIG. 9 is a graph showing a characteristic fluctuation of the upstream oxygen sensor 4.

FIG. 9 is a graph showing a characteristic fluctuation of the upstream oxygen sensor 4. A curve Cv2 representing an output profile of the upstream oxygen sensor 4 in the initial state may change into a curve Cv3 representing an output profile because of the characteristic fluctuation. Here, the amount of variation in the output values that should indicate the theoretical air-fuel ratio is shown as the characteristic fluctuation.

First, the changes of the values in the comparative example shown in FIG. 8 (dash-dotted lines) are discussed.

Fuel injection amount temporarily becomes zero due to a fuel cutoff (time t11); then, until the lapse of a predetermined period T0, which has been set in advance, from the reversion from the fuel cutoff state at time t12 (time t12–t14), the upstream target-value varying part 9 performs only the proportional operation and stops the integral operation, retaining the downstream integral value. Then, at the time t14, the integral operation in the upstream target-value varying part 9 is restarted after the lapse of the predetermined period T0. However, as shown in FIG. 8, because of the characteristic fluctuation of the upstream oxygen sensor 4, the downstream integral value before the fuel cutoff is unable to compensate the characteristic fluctuation sufficiently. In addition, at the time t13, although the downstream air-fuel-ratio output value and the amount of oxygen storage (AOS) have reverted to those values immediately before the fuel cutoff, the downstream integral value that is unable to sufficiently compensate the characteristic fluctuation is retained from the time t13 to the time t14, deficiencies in functions occur due to the halt of the integral operation. As a result, emission deteriorates considerably.

In contrast, with the air-fuel ratio control device 100 according to the present preferred embodiment, the upstream target-value varying part 9 performs only the proportional operation and stops the integral operation, retaining the downstream integral value, until the cumulative air amount Qa reaches the predetermined air amount Xqa after the reversion from the fuel cutoff state at the time t12 (time t12–t13), as represented by the solid lines in FIG. 8. Then, at the time t13, the amount of oxygen storage (AOS) has reverted to the value before the fuel cutoff, and the downstream air-fuel-ratio output value also reverts to the value immediately before the fuel cutoff. Therefore, when the integral operation of the upstream target-value varying part 9 is forcibly restarted at the time t13, the downstream integral value instantly increases in order to compensate the characteristic fluctuation of the upstream oxygen sensor 4, and the downstream air-fuel-ratio output value stabilizes at an early state by reaching the downstream target value. As a result, it is possible to suppress deterioration of emissions or the like after the fuel cutoff.

As described above, the air-fuel ratio control device 100 according to the present preferred embodiment stops the integral operation in the upstream target-value varying part 9 in response to transition to a fuel cutoff state to maintain the downstream integral value. Thereafter, at a time of removal of the fuel cutoff state, when the cumulative value Qa of the amount of the air taken into an internal combustion engine (the engine 1 herein) reaches the predetermined air amount Xqa, the integral operation in the upstream target-value varying part 9 is restarted to update the downstream integral values in a time sequence. That is, the time for restarting the integral operation concerning the downstream side of the catalytic converter 3 that has been stopped by entering the fuel cutoff state is set at a time when the cumulative air amount Qa after the fuel cutoff, which represents the behavior of amount of oxygen storage after the fuel cutoff, reaches the predetermined air amount Xqa. By adopting such a configuration, it is possible to suppress malfunctions in the feedback control of the air-fuel ratio and at the same time to reduce deficiency in function due to the halt of the integral operation. As a result, the air-fuel ratio after the fuel cutoff can be controlled to be an appropriate value, and deterioration of emissions or the like after the fuel cutoff can be suppressed.

Moreover, with adjusting the upstream target value using only a proportional operation so as to match the downstream air-fuel-ratio output value and the downstream target value, a cumulative air amount from the time of removal of the fuel cutoff state until the time when the downstream air-fuel-ratio output value matches the downstream target value is obtained experimentally as a predetermined air amount Xqa, and is thus adopted. As a result, the predetermined air amount Xqa can be easily set in advance based on a measurement.

<Modified Example>

Hereinabove, a preferred embodiment of this invention has been described, but it should be understood that the invention is not to be limited to the form that has been described above.

For example, in the above-described preferred embodiment, the integral operation in the upstream target-value varying part 9 is restarted in response to the attainment of the cumulative air amount Qa to the predetermined air amount Xqa after the removal of the fuel cutoff state, but preferred embodiments are not limited thereto; for example, the integral operation in the upstream target-value varying part 9 may be restarted at after the lapse of a predetermined period (for example, about 2 seconds) from the time when the cumulative air amount Qa reaches the predetermined air amount Xqa.

When the predetermined air amount Xqa is obtained experimentally by the previously-described technique, there may be cases in which, depending on a setting, the downstream air-fuel-ratio output value stabilizes in the vicinity of the downstream target value after a slight excessive amount occurs: for example, the downstream air-fuel-ratio output value slightly overshoots with respect to the downstream target value after the downstream air-fuel-ratio output value and the downstream target value have matched. Moreover, in an actual operation the engine 1, there may be cases in which the downstream air-fuel-ratio output value is more difficult to stabilize in the vicinity of the downstream target value than the cases in which the predetermined air amount Xqa is obtained experimentally. In such cases, if the integral operation in the upstream target-value varying part 9 is restarted immediately after the cumulative air amount Qa has reached the predetermined air amount Xqa, problems arise such as malfunctions in PI control because excessive correction occurs.

For this reason, a configuration may be adopted in which the integral operation in the upstream target-value varying part 9 is restarted after the lapse of a predetermined period from a time after of the cumulative air amount Qa reached a predetermined air amount Xqa has elapsed, in order to provide an additional margin for the downstream air-fuel-ratio output value to stabilize in the vicinity of the downstream target value after the reversion from the transient state due to a fuel cutoff. In other words, a configuration may be employed in which a delay in the restarting timing of the integral operation (restart delay) may be provided.

It should be noted that the time until a downstream air-fuel-ratio output value stabilizes in the vicinity of the downstream target value after a slight excessive amount is caused, as a case in which the downstream air-fuel-ratio output value shows a slight overshoot with respect to the downstream target value is in proportional to a cumulative amount of air intake amount, and therefore, a predetermined air amount Xqa for regulating timing of the integral operation may be set at a value in which an air intake amount corresponding to the restart delay is added up to the predetermined air amount Xqa.

Thus, by allowing the restarting timing of the integral operation to have an additional margin until the downstream air-fuel-ratio output value stabilizes in the vicinity of the downstream target value, malfunctions in the feedback control of air-fuel ratio can be suppressed more reliably.

In addition, in the above-described preferred embodiment, the integral operation in the upstream-target-value varying part 9 is restarted in response to the attainment of the cumulative air amount Qa to the predetermined air amount Xqa after the fuel cutoff state is removed, but preferred embodiments are not limited thereto; for example, the integral operation in the upstream-target-value varying part 9 may be restarted in response to a match that has been obtained between the downstream air-fuel-ratio output value and the downstream target value after the removal of the fuel cutoff state.

By adopting such a configuration too, it becomes possible to malfunctions in the feedback control of the air-fuel ratio can be suppressed, as shown in FIG. 7. As a result, the air-fuel ratio after the fuel cutoff can be controlled to be an appropriate value so that deterioration of emissions or the like after the fuel cutoff can be suppressed.

However, it is difficult to adapt such a configuration when, as shown in FIG. 8, a characteristic fluctuation occurs in the upstream oxygen sensor 4 and an operation to compensate the characteristic fluctuation by increasing the downstream integral value before the fuel cutoff is in progress, so the downstream air-fuel-ratio output value is smaller than the downstream target value immediately before the fuel cutoff. The reason is that if downstream integral value is retained after the fuel cutoff, the downstream air-fuel-ratio output value will not match the downstream target value.

Nevertheless, if, for example, the downstream air-fuel-ratio output value immediately before the fuel cutoff is stored to forcibly restart the integral operation in the upstream-target-value varying part 9 after the removal of the fuel cutoff state in response to the reversion of the downstream air-fuel-ratio output value to the downstream air-fuel-ratio output value immediately before the fuel cutoff, the respective values will show the changes represented by the solid lines in FIG. 8. In other words, similar advantageous effects to the above-described preferred embodiment can be attained.

Further, in order to provide an additional margin from a time of the reversion from the transient state due to a fuel cutoff to a time when the downstream air-fuel-ratio output value stabilizes in the vicinity of the downstream target value, the integral operation in the upstream-target-value varying part 9 may be restarted, for example, after the removal of the fuel cutoff state and after the lapse of a predetermined short period (for example, for about 2 seconds) from a time when the downstream air-fuel-ratio output value matches the downstream target value. Specifically, the configuration may be such that a delay (restart delay) in restarting timing for the integral operation is provided. By providing an ad ditional margin for the restarting timing for the integral operation until the downstream air-fuel-ratio output value stabilizes in the vicinity of the downstream target value, it becomes possible to suppress malfunctions in the feedback control of the air-fuel ratio more reliably.

It should be noted that in this case, it is possible to restart the integral operation in the upstream-target-value varying part 9 after it has been detected that the downstream air-fuel-ratio output value has stabilized in the vicinity of the downstream target value to a certain degree by monitoring the downstream air-fuel-ratio output value with the downstream oxygen sensor 5. In addition, it is possible to restart the integral operation in the upstream-target-value varying part 9 after it has been detected that the downstream air-fuel-ratio output value has stabilized to a certain degree in the vicinity of the downstream air-fuel-ratio output value immediately before the fuel cutoff.

In addition, although the above-described preferred embodiment uses, for the downstream oxygen sensor 5, such a λ-type oxygen concentration sensor that its output abruptly changes in the vicinity of the theoretical air-fuel ratio with respect to a change of the air-fuel ratio and shows a substantially binary output toward and past the theoretical air-fuel ratio, as shown in FIG. 3, but preferred embodiments are not limited thereto; similar advantageous effects to those of the above-described preferred embodiment can also be attained by, for example, using a linear-type oxygen concentration sensor having such an output profile that its output value changes substantially linearly with respect to a change in the air-fuel ratio as shown in FIG. 4.

Further, although the above-described preferred embodiment uses, for the upstream oxygen sensor 4, a linear-type oxygen concentration sensor having such an output profile that its output value changes substantially linearly with respect to a change in the air-fuel ratio as shown in FIG. 4, but preferred embodiments are not limited thereto; similar advantageous effects to those of the above-described preferred embodiment can also be attained by, for example, using a λ-type oxygen concentration sensor having such an output profile that its output abruptly changes in the vicinity of the theoretical air-fuel ratio with respect to a change of the air-fuel ratio and shows a substantially binary output toward and past the theoretical air-fuel ratio as shown in FIG. 3.

In addition, although the above-described preferred embodiment adopts a configuration in which the fuel-supply-amount correcting-coefficient calculating part 8 carries out a PID control, in which an integral operation, a proportional operation, and a differentiation operation are performed, the invention is not limited thereto; similar advantageous effects to those of the above-described preferred embodiment can be attained when, for example, a control is performed using only one of the integral operation, the proportional operation, and the differentiation operation, or using any combinations thereof.

Furthermore, although the above-described preferred embodiment adopts a configuration in which the upstream target-value varying part 9 carries out a PI control, in which a proportional operation and an integral operation are performed, the invention is not limited thereto; for example, similar advantageous effects to those of the above-described preferred embodiment can be attained by employing such a configuration that carries out a PID control, in which an integral operation, a proportional operation, and a differentiation operation are performed.

While the invention has been shown and described in detail, the foregoing description is in all aspects illustrative and not restrictive. It is therefore understood that numerous other modifications and variations can be devised without departing from the scope of the invention.

What is claimed is:

1. An air-fuel ratio control device for an internal combustion engine, comprising:

an upstream detector part provided in an exhaust system of said internal combustion engine, for detecting a concentration of a particular component in an exhaust gas in an upstream side of a catalytic converter for cleaning the exhaust gas;

a downstream detector part provided in said exhaust system, for detecting a concentration of a particular component in the exhaust gas in a downstream side of said catalytic converter;

an air-fuel-ratio adjusting part for adjusting an air-fuel ratio by controlling an amount of a fuel supply to said internal combustion engine;

a control part for controlling said air-fuel-ratio adjusting part so that an output value of said upstream detector part and an upstream target value match each other;

a target-value varying part for changing said upstream target value using a proportional operation and an integral operation so that an output value of said downstream detector part and a downstream target value match each other;

a state-detecting part for detecting a fuel cutoff state in which a fuel supply to said internal combustion engine is stopped;

a cumulative-amount detecting part for detecting a cumulative amount of air taken into said internal combustion engine from a time at which said fuel cutoff state is removed; and a stop/restart part for stopping said integral operation in response to detection of said fuel cutoff state by said state-detecting part, and restarting said integral operation in response to attainment of said cumulative air amount to a predetermined air amount.

2. The air-fuel ratio control device for an internal combustion engine according to claim 1, wherein said stop/restart part restarts said integral operation after a lapse of a predetermined period from a time at which said cumulative air amount has reached said predetermined air amount.

3. The air-fuel ratio control device for an internal combustion engine according to claim 1, wherein, if said target value-varying part is allowed to perform only a proportional operation using a deviation between said output value of said downstream detector part and said downstream target value, a value obtained in advance as a cumulative amount of air that is taken into said internal combustion engine during a period from a time of removal of said fuel cutoff state until a time when said output value of said downstream detector part and said downstream target value match each other is set as said predetermined air amount.

4. The air-fuel ratio control device for an internal combustion engine according to claim 2, wherein, if said target value-varying part is allowed to perform only a proportional operation using a deviation between said output value of said downstream detector part and said downstream target value, a value obtained in advance as a cumulative amount of air that is taken into said internal combustion engine during a period from a time of removal of said fuel cutoff state until a time when said output value of said downstream detector part and said downstream target value match each other is set as said predetermined air amount.

5. An air-fuel ratio control device for an internal combustion engine, comprising:

an upstream detector part provided in an exhaust system of said internal combustion engine, for detecting a concentration of a particular component in an exhaust gas in an upstream side of a catalytic converter for cleaning the exhaust gas;

a downstream detector part provided in said exhaust system, for detecting a concentration of a particular component in the exhaust gas in a downstream side of said catalytic converter;

an air-fuel-ratio adjusting part for adjusting an air-fuel ratio by controlling an amount of a fuel supply to said internal combustion engine;

a control part for controlling said air-fuel-ratio adjusting part so that an output value of said upstream detector part and an upstream target value match each other;

a target-value varying part for changing said upstream target value using a proportional operation and an integral operation so that an output value of said downstream detector part and a downstream target value match each other;

a state-detecting part for detecting a fuel cutoff state in which a fuel supply to said internal combustion engine is stopped; and a stop/restart part for stopping said integral operation in response to transition to said fuel cutoff state, and restarting said integral operation in response to a match between said output value of said downstream detector part and said downstream target value after removal of said fuel cutoff state.

6. The air-fuel ratio control device for an internal combustion engine according to claim 5, wherein said stop/restart part restarts said integral operation after a lapse of a predetermined period from a time at which said output value of said downstream detector part and said downstream target value have matched each other.

* * * * *